US011012777B2

(12) United States Patent
Xu et al.

(10) Patent No.: US 11,012,777 B2
(45) Date of Patent: May 18, 2021

(54) AUDIO ADJUSTMENT METHOD AND ELECTRONIC DEVICE THEREOF

(71) Applicant: Lenovo (Beijing) Co., Ltd., Beijing (CN)

(72) Inventors: Haifeng Xu, Beijing (CN); Yonglian Zhou, Beijing (CN)

(73) Assignee: LENOVO (BEIJING) CO., LTD., Beijing (CN)

( * ) Notice: Subject to any disclaimer, the term of this patent is extended or adjusted under 35 U.S.C. 154(b) by 0 days.

(21) Appl. No.: 16/430,080

(22) Filed: Jun. 3, 2019

(65) Prior Publication Data

US 2019/0373367 A1 Dec. 5, 2019

(30) Foreign Application Priority Data

Jun. 1, 2018 (CN) ..... 201810558957.6

(51) Int. Cl.
*H04R 3/04* (2006.01)
*H04R 1/32* (2006.01)
*H04R 29/00* (2006.01)

(52) U.S. Cl.
CPC ..... *H04R 3/04* (2013.01); *H04R 1/326* (2013.01); *H04R 29/001* (2013.01); *H04R 2430/01* (2013.01)

(58) Field of Classification Search
CPC ..... H03G 5/165; H04R 3/04; H04R 2430/01
USPC ..... 381/103, 94.9
See application file for complete search history.

(56) References Cited

U.S. PATENT DOCUMENTS

2005/0219223 A1 10/2005 Kotzin et al.
2008/0130867 A1* 6/2008 Bowen ..... H04M 1/03 379/443
2012/0106747 A1* 5/2012 Crockett ..... H04S 7/301 381/57
2012/0182539 A1* 7/2012 Grokop ..... G01B 11/026 356/4.01
2016/0165341 A1* 6/2016 Benattar ..... G01S 3/801 381/92
2016/0212532 A1* 7/2016 Grokop ..... H04R 29/001
2017/0265012 A1* 9/2017 Tico ..... H04R 3/005
2017/0269579 A1 9/2017 Griffiths et al.

FOREIGN PATENT DOCUMENTS

CN 102333142 A 1/2012
CN 102752687 A 10/2012
CN 104079248 A 10/2014
CN 104104346 A 10/2014
CN 104598193 A 5/2015
CN 105224280 A 1/2016
CN 105979447 A 9/2016
CN 107506167 A 12/2017
CN 107749925 A 3/2018
JP H107252047 A 10/1995

* cited by examiner

*Primary Examiner* — Alexander Krzystan
(74) *Attorney, Agent, or Firm* — Anova Law Group, PLLC

(57) ABSTRACT

An audio adjustment method for an electronic device having an audio playback function includes: acquiring an interference parameter, the interference parameter characterizing an impact of an interference surface on the audio playback function of the electronic device; determining a first audio parameter that corresponds to the interference parameter; and adjusting audio playback of the electronic device according to the first audio parameter.

12 Claims, 18 Drawing Sheets

AUDIO ADJUSTMENT METHOD AND ELECTRONIC DEVICE THEREOF

CROSS-REFERENCE TO RELATED APPLICATION

This application claims the priority to Chinese Patent Application No. 201810558957.6, entitled "Audio adjustment method and electronic device thereof," filed on Jun. 1, 2018, the entire content of which is incorporated herein by reference.

TECHNICAL FIELD

The present disclosure relates to the field of electronic devices, and more particularly to an audio adjustment method and an electronic device thereof.

BACKGROUND

With the development of electronic technology, various audio playback devices have been developed. However, in existing systems, the sound quality may only be adjustable according to a manual input from a user, such as the user manually adjusting the volume of the playback. The sound quality resulted from the adjustment may be unsatisfactory in certain scenarios.

SUMMARY

In one aspect of the present disclosure, an audio adjustment method for an electronic device having an audio playback function is provided. The method includes: acquiring an interference parameter, the interference parameter characterizing an impact of an interference surface on the audio playback function of the electronic device; determining a first audio parameter that corresponds to the interference parameter; and adjusting audio playback of the electronic device according to the first audio parameter.

In certain embodiments of the audio adjustment method, acquiring the interference parameter includes acquiring an occlusion parameter, the occlusion parameter characterizing an occlusion effect of the interference surface on the audio playback function of the electronic device.

In certain embodiments of the audio adjustment method, acquiring the occlusion parameter includes: acquiring a first detection parameter via a first sensor, the first sensor configured with a detection direction corresponding to a sound emission direction of an audio output element of the electronic device; and determining whether the sound emission direction of the audio output element is toward the interference surface according to the first detection parameter.

In certain embodiments of the audio adjustment method, acquiring the occlusion parameter includes: acquiring a second detection parameter via a second sensor, the second sensor being placed on a sound emitting plane of an audio output element of the electronic device; and determining whether the sound emitting plane is close to the interference surface according to the second detection parameter.

In certain embodiments of the audio adjustment method, acquiring the interference parameter includes acquiring a material parameter characterizing a material of the interference surface.

In certain embodiments of the audio adjustment method, acquiring the material parameter includes one of: measuring a dielectric constant of the interference surface, and determining the material of the interference surface according to the dielectric constant; measuring a magnetic permeability of the interference surface, and determining the material of the interference surface according to the magnetic permeability; or measuring a spectrum of the interference surface, and determining the material of the interference surface according to the spectrum.

In certain embodiments of the audio adjustment method, adjusting the audio playback of the electronic device according to the first audio parameter includes: identifying a first frequency corresponding to the material of the interference surface by searching a correspondence relationship between a plurality of materials and a plurality of natural frequencies; determining a volume impact value corresponding to the first frequency according to an analysis rule; determining an adjusted volume level according to an initial volume level in an audio output of a first audio output element of the electronic device at the first frequency and the volume impact value corresponding to the first frequency; and adjusting a volume level of the audio output of the first audio output element at the first frequency.

In certain embodiments, the audio adjustment method further includes increasing the volume level in the audio output of the first audio output element according to an adjustment rule.

In certain embodiments of the audio adjustment method, determining the first audio parameter that corresponds to the interference parameter includes: identifying a first audio output element from a plurality of audio output elements, the first audio output element being an audio output element facing the interference surface; determining a material of a target region of the interference surface, the target region corresponding to a sound emission range of the first audio output element; and acquiring an adjustment parameter of the first audio output element according to the material of the target region.

In certain embodiments of the audio adjustment method, identifying the first audio output element from the plurality of audio output elements of the electronic device includes: acquiring a first detection parameter via a first sensor, the first sensor having a plurality of detection directions, each detection direction respectively corresponding to a sound emission direction of one of the plurality of audio output elements of the electronic device; and identifying the first audio output element from the plurality of audio output elements according to the first detection parameter.

In certain embodiments of the audio adjustment method, identifying the first audio output element from the plurality of audio output elements of the electronic device includes: acquiring a plurality of second detection parameters via a plurality of second sensor elements, each second sensor element respectively placed on a sound emitting plane of one of the plurality of audio output elements of the electronic device; and identifying the first audio output element from the plurality of audio output elements according to the plurality of second detection parameters.

In another aspect of the present disclosure, an electronic device having an audio playback function is provided. The electronic device includes: a main body; an audio output element configured on the main body; and a processor configured to: acquire an interference parameter, the interference parameter characterizing an impact of an interference surface on the audio playback function of the electronic device; determine an audio parameter that corresponds to the interference parameter; and adjust audio playback of the electronic device according to the audio parameter.

In certain embodiments, electronic device further includes a first sensor configured with a detection direction corresponding to a sound emission direction of the audio output element. The processor is further configured to determine whether the sound emission direction of the audio output element is toward the interference surface according to a first detection parameter acquired by the first sensor.

In certain embodiments, the electronic device further comprise a second sensor configured on a sound emitting plane of the audio output element of the electronic device. The processor is further configured to determine whether the sound emitting plane is close to or in contact with the interference surface according to a second detection parameter acquired by the second sensor.

In certain embodiments of the electronic device, the processor is further configured to: determine a material of the interference surface; identify a first frequency corresponding to the material of the interference surface by searching a correspondence relationship between a plurality of materials and a plurality of natural frequencies; determine a volume impact value corresponding to the first frequency according to an analysis rule; determine an adjusted volume level according to an initial volume level in an audio output of the audio output element at the first frequency and the volume impact value corresponding to the first frequency; and adjust a volume level of the audio output of the audio output element at the first frequency.

In certain embodiments of the electronic device, the processor is further configured to increase the volume level of the audio output of the audio output element according to an adjustment rule.

In another aspect of the present disclosure, an electronic device having an audio playback function is provided. The electronic device includes: a main body; a plurality of audio output elements configured in the main body; and a processor configured to: identify a first audio output element from the plurality of audio output elements of the electronic device, the first audio output element being an audio output element facing the interference surface; acquire an interference parameter, the interference parameter characterizing an impact of an interference surface on the audio playback function of the electronic device; determine a first audio parameter that corresponds to the interference parameter; and adjust an audio output of the first audio output element according to the first audio parameter.

In certain embodiments of the electronic device, the processor is further configured to: determine a material of a target region of the interference surface, the target region corresponding to a sound emission range of the first audio output element; and acquiring an adjustment parameter of the first audio output element according to the material of the target region.

In certain embodiments of the electronic device, the processor is further configured to: acquire a first detection parameter via a first sensor, the first sensor having a plurality of detection directions, each detection direction respectively corresponding to a sound emission direction of one of the plurality of audio output elements; and identify the first audio output element from the plurality of audio output elements according to the first detection parameter.

In certain embodiments of the electronic device, the processor is further configured to: acquire a plurality of second detection parameters via a plurality of second sensor elements, each second sensor element respectively configured on a sound emitting plane of one of the plurality of audio output elements; and identifying the first audio output element from the plurality of audio output elements according to the plurality of second detection parameters.

The above aspects will be described in detail with accompanying drawings.

BRIEF DESCRIPTION OF THE DRAWINGS

In order to more clearly illustrate the technical solutions provided by the present disclosure, the drawings used in the description of the embodiments will be briefly described below.

DETAILED DESCRIPTION OF THE EMBODIMENTS

The technical solutions provided by the present disclosure according to various embodiments are described below with reference to the drawings. The described embodiments are only part of the embodiments of the present disclosure. Other embodiments acquired by a person of ordinary skill in the art based on the described embodiments without departing from the spirit of the disclosure are the within scope of the present disclosure.

In the various embodiments, an electronic device may include an audio output element. The audio output element may be configured on a surface of the electronic device. One or more audio output elements may be configured on different sides of the electronic device.

Figure 1:
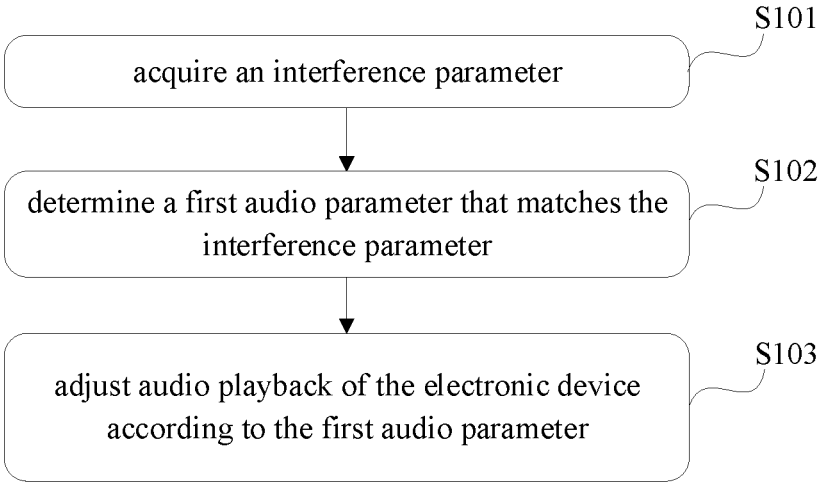
FIG. 1 is a flowchart illustrating an audio adjustment method according to certain embodiments of the present disclosure.

FIG. 1 illustrates an audio adjustment method according to certain embodiments of the present disclosure. The audio adjustment method may be applied to an electronic device that has an audio playback function. The audio adjustment method may include the following steps.

Step S101 is to acquire an interference parameter. The interference parameter may characterize an impact of an interference surface on the audio output of the electronic device. The interference surface may be defined as a surface that is close to or in contact with the electronic device.

During the propagation of a sound wave in air, the sound wave may be reflected when encountering an obstacle object. Therefore, when the electronic device is close to or in contact with a surface, the surface may affect the sound propagation. The impact of the surface (i. e., interference surface) on the audio output of the electronic device may be characterized by the influential parameter.

The approaching or contacting between the electronic device and the interference surface may include a portion of the electronic device being in contact with the interference surface. The portion of the electronic device may include any one of a face, an edge, or a corner of the electronic device.

In certain embodiments, different interference surfaces may have different impacts on the audio output of the electronic device. Interference surfaces may be categorized according to their materials, relative positions to the electronic device, and other factors. The impact of interference surface on the electronic device may be characterized and quantified using the interference parameter.

Step S102 is to determine a first audio parameter that matches the interference parameter. The electronic device may determine the first audio parameter by analyzing the interference parameter. The first audio parameter may include a to-be-adjusted frequency and a target volume level corresponding to the to-be-adjusted frequency.

In certain embodiments, the audio playback frequency of the electronic device may be within a frequency range. The electronic device may adjust the volume levels corresponding to one or more frequencies in the frequency range.

Step S103 is to adjust audio playback of the electronic device according to the first audio parameter. In certain embodiments, the electronic device may adjust its audio playback according to the first audio parameter. For example, the electronic device may adjust the volume at one or more frequencies in the audio output correspondingly to achieve a better sound quality.

In certain embodiments, the first audio parameter may be matched to the interference parameter of the interference surface. The electronic device may adjust its audio playback according to the first audio parameter. Thus, sound quality of the electronic device may be optimized, reducing the impact of the interference surface.

In summary, an audio adjustment method provided by the present disclosure according to certain embodiments may include: acquiring an interference parameter that characterizes an impact of a interference surface on the audio output of the electronic device; determining a first audio parameter that matches the interference parameter; and adjusting audio playback of the electronic device according to the first audio parameter. The interference surface may be a surface close to or in contact with the electronic device. By using the method, the electronic device may adjust its playback parameters accounting for the impact of an interference surface close to or in contact with the electronic device, optimizing the sound quality of the electronic device.

Figure 2:
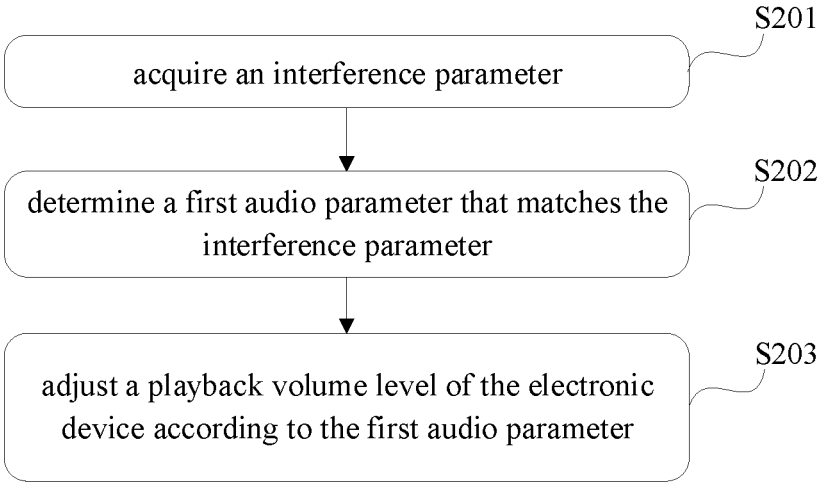
FIG. 2 is a flowchart illustrating an audio adjustment method according to certain other embodiments of the present disclosure.

FIG. 2 illustrates an audio adjustment method according to certain other embodiments of the present disclosure. As shown in FIG. 2, according to certain embodiments, an audio adjustment method may include the following the steps.

Step S201 is to acquire an interference parameter. Step S202 is to determine a first audio parameter that matches the interference parameter. Steps S201 and 202 may be consistent with Steps S101 and 102 in the forgoing embodiments referencing FIG. 1, and their detailed descriptions are not repeated.

Step S203 is to adjust a playback volume level of the electronic device according to the first audio parameter. In certain embodiments, the first audio parameter may be matched to the interference parameter of the interference surface, and the electronic device may adjust its audio playback according to the first audio parameter. The first audio parameter may include a playback volume level be reached by the electronic device. Thus, the sound quality of the electronic device may be optimized, reducing the impact of the interference surface.

In certain embodiments, the electronic device may adjust its audio playback according to the first audio parameter. For example, the volume of the audio playback may be adjusted at a certain frequency or all frequencies to achieve a better sound quality.

In summary, in an audio adjustment method according to certain embodiments, the process of adjusting the audio playback of the electronic device may include adjusting a volume level during playback of the electronic device, reducing the impact of the interference surface.

Figure 3:
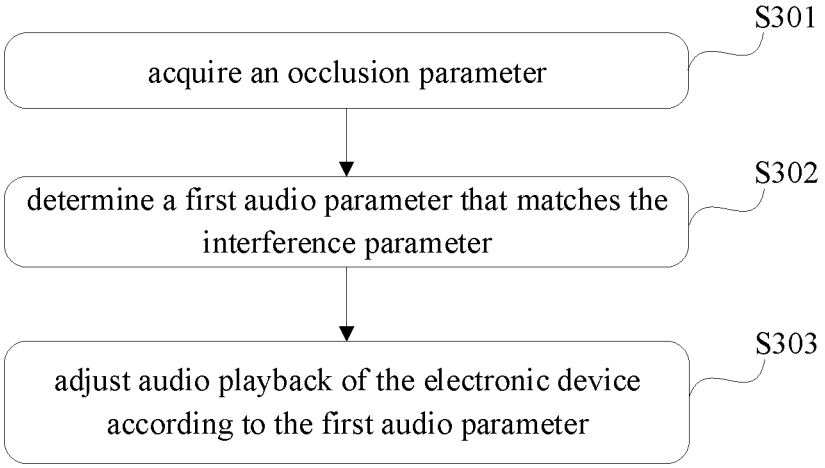
FIG. 3 is a flowchart illustrating an audio adjustment method according to certain other embodiments of the present disclosure.

FIG. 3 illustrates an audio adjustment method according to certain other embodiments of the present disclosure. As shown in FIG. 3, an audio adjustment method may include the following the steps.

Step S301 is to acquire an occlusion parameter. The occlusion parameter may characterize an occlusion effect of an interference surface on the audio playback of the electronic device. In certain embodiments, when the electronic device is close to or in contact with the interference surface, the interference surface may have an occlusion effect on the audio playback of the electronic device. In certain embodiments, acquiring the occlusion parameter may include one or more of the following processes.

In one process, a first sensor may acquire a first detection parameter. The first sensor may be configured with its detection direction matching a sound emission direction of at least one audio output element of the electronic device. The electronic device may determine that the sound emission is directed toward the interference surface according to the first detection parameter. The interference surface in this case may be a bearing surface carrying the electronic device.

In another process, a second sensor may acquire a second detection parameter. The second sensor may be configured on a sound emitting plane of at least one audio output element of the electronic device. The electronic device may determine that the sound emitting plane is close to or in contact with the interference surface according to the second detection parameter. In certain embodiments, the audio output element may be a speaker of the electronic device. The electronic device may have multiple speakers. The speakers may be distributed on different faces of the electronic device.

In certain embodiments, the first sensor may be implemented as a gravity sensor. In certain embodiments, the gravity sensor may detect a posture of the electronic device. Based on the posture of the electronic device, the electronic device may determine a positional relationship between the electronic device and the bearing surface carrying the electronic device.

For example, when the gravity sensor detects that the electronic device is in an upright state, the sound emission direction of each audio output element of the electronic device may be consistent with its initial configuration. That is, a top audio output element may emit audio in the upward direction, and a side audio output element may emit audio in the sideway direction.

In another example, when the gravity sensor detects that the electronic device is in a non-upright state, the sound emission direction of each audio output element of the electronic device may be inconsistent with its initial configuration. The top audio output element may emit audio in a sideway direction. Some side audio output elements may emit audio in sideway directions. Some other side audio output elements may emit audio in the upward or downward directions.

When the sound emission direction of an audio output element of the electronic device is directed toward the bearing surface, the electronic device may be determined to be lying sideways on the bearing surface. In this case, the sound quality of the audio output element may be affected, and the overall sound quality of the electronic device may also be affected. The electronic device may determine the posture of the electronic device relative to the bearing surface by analyzing the first detection parameter detected by the gravity sensor.

The second sensor may be configured on the sound emitting plane of at least one audio output element of the electronic device. The electronic device may determine whether the sound emitting plane is close to or in contact with the interference surface by analyzing the second detection parameter acquired by the second sensor.

In certain embodiments, the second detection parameter may include one or more of: a dielectric constant of the interference surface, a magnetic permeability of the interference surface, or a distance between the interference surface and the sound emitting plane. The dielectric constant and/or the magnetic permeability of air are different from those of other objects. The electronic device may determine whether there are other objects (i. e, interference surfaces) close to the sound source by measuring the dielectric constant, the magnetic permeability, and so on in the surrounding environment.

The second sensor may be implemented as a capacitive proximity sensor to measure the dielectric constant. It may also be implemented as a magnetic permeability meter to measure the magnetic permeability, or a distance sensor to measure the distance between the interference surface and the sound emitting plane.

Step S302 is to determine a first audio parameter that matches the interference parameter. Step S303 is to adjust audio playback of the electronic device according to the first audio parameter. Steps S302 and S303 may be consistent with Steps S102 and S103 in the forgoing embodiments referencing FIG. 1, and their detailed descriptions are not repeated.

In summary, acquiring the interference parameter according to certain embodiments may include acquiring an occlusion parameter characterizing an occlusion effect on the audio playback of the electronic device. By adopting the audio adjustment method, the electronic device may acquire the occlusion parameter and determine the occlusion effect on the audio playback of the electronic device. Thus, the electronic device may adjust its audio playback according to the occlusion parameter in subsequent steps.

Figure 4:
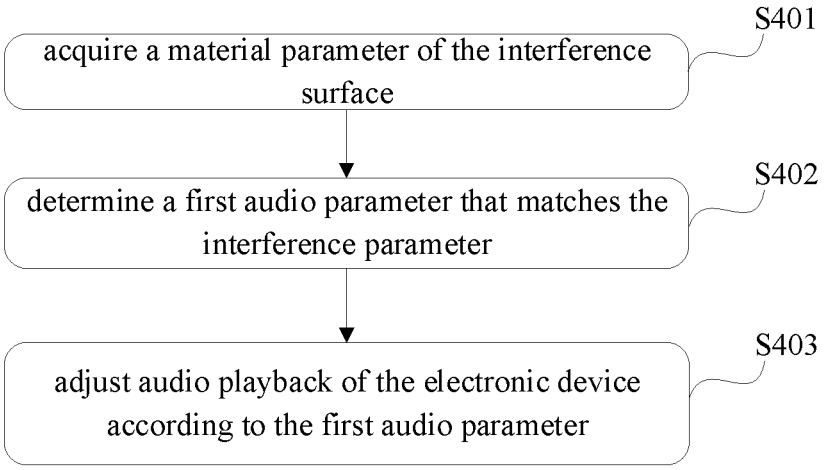
FIG. 4 is a flowchart illustrating an audio adjustment method according to certain other embodiments of the present disclosure.

FIG. 4 illustrates an audio adjustment method according to certain other embodiments of the present disclosure. As shown in FIG. 4, according to certain embodiments, an audio adjustment method may include the following the steps.

Step S401 is to acquire a material parameter of the interference surface. The material parameter may catheterize a material of the interference surface.

In certain embodiments, the interference surface may be close to or in contact with the electronic device, thus having a certain impact on the audio output of the electronic device due to the its interaction with sound propagation. The interference surface composed of different materials may have different impacts on the audio output. For example, interference surfaces made of different materials such as wood, glass, or stone, may have different effects on sound. In certain embodiments, acquiring a material parameter of the interference surface may include one or more of the following processes.

In one process, the electronic device may measure a dielectric constant of the interference surface and determine a material of the interference surface according to the dielectric constant. In another process, the electronic device may measure a magnetic permeability of the interference surface and determine a material of the interference surface according to the magnetic permeability. In another process, the electronic device may measure a spectrum of the interference surface and determine a material of the interference surface according to the spectrum. In certain embodiments, the electronic device may determine the material of the interference surface according to one or more of a dielectric constant, a magnetic permeability, a spectrum, and the like of the interference surface.

The electronic device may measure the dielectric constant of the interference surface using a capacitive proximity sensor. The electronic device may measure the magnetic permeability of the interference surface using a magnetic permeability sensor. The electronic device may measure the spectrum of the interference surface using an optical spectrum analyzer.

In certain embodiments, a user may manually input material information of the interference surface to the electronic device, and a sensor may not be necessary to acquire the material information.

Step S402 is to determine a first audio parameter that matches the interference parameter. Step S403 is to adjust audio playback of the electronic device according to the first audio parameter. Steps S402 and S403 may be consistent with Steps S102 and S103 in the forgoing embodiments referencing FIG. 1, and their detailed descriptions are not repeated.

In summary, in the audio adjustment method according to certain embodiments, acquiring the interference parameter may include acquiring a material parameter of the interference surface characterizing a material of the interference surface. By adopting the method, the electronic device may acquire the material parameters of the interference surface and determine the interference surface's impact on the audio playback of the electronic device. In the subsequent steps, the electronic device may adjust audio playback according to the material parameter.

Figure 5:
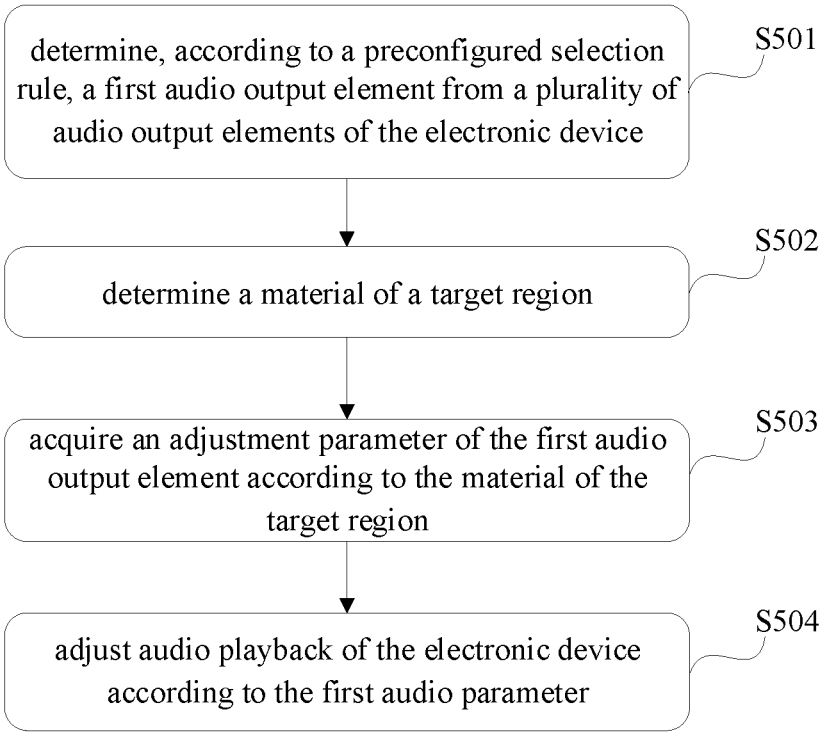
FIG. 5 is a flowchart illustrating an audio adjustment method according to certain other embodiments of the present disclosure.

FIG. 5 illustrates an audio adjustment method according to certain other embodiments of the present disclosure. As shown in FIG. 5, according to certain embodiments, an audio adjustment method may include the following the steps.

Step S501 is to determine, according to a preconfigured selection rule, a first audio output element from a plurality of audio output elements of the electronic device. In certain embodiments, the first audio output element may be an audio output element facing the interference surface. In certain embodiments, the electronic device may have a plurality of audio output elements. Each audio output element may face a different direction according to its position configuration. When the electronic device is close to or in contact with an interference surface, audio output of an audio output element in the electronic device facing the interference surface may be impacted by the interference surface.

Step S502 is to determine a material of a target region. The target region may be a part of an interference surface corresponding to a sound emission range of the first audio output element.

In certain embodiments, the electronic device may be in contact with or close to an area of the interference surface. The electronic device may have a contact or proximity portion relative the interference surface. For example, the contact/proximity portion may an edge or a corner of the electronic device. An angle between the electronic device and the interference surface may be an acute angle (0°-90°).

When there is a contact/proximity portion of the electronic device relative to the interference surface, electronic device may be positioned with a tilt relative to the interference surface. For example, the electronic device may be tilted in its position or the interference surface may be tilted in its position. For example, when the interference surface is a bearing surface for carrying the electronic device, the bearing surface may a surface parallel to the horizontal plane. When the electronic device is not in a leveled placement configuration, there may be an inclination relative to the bearing surface to form an angle. In certain embodiments, when the surface of the bearing surface is not flat, it may have a relatively small impact on the audio playback of the electronic device and the impact may be omitted.

Figure 6:
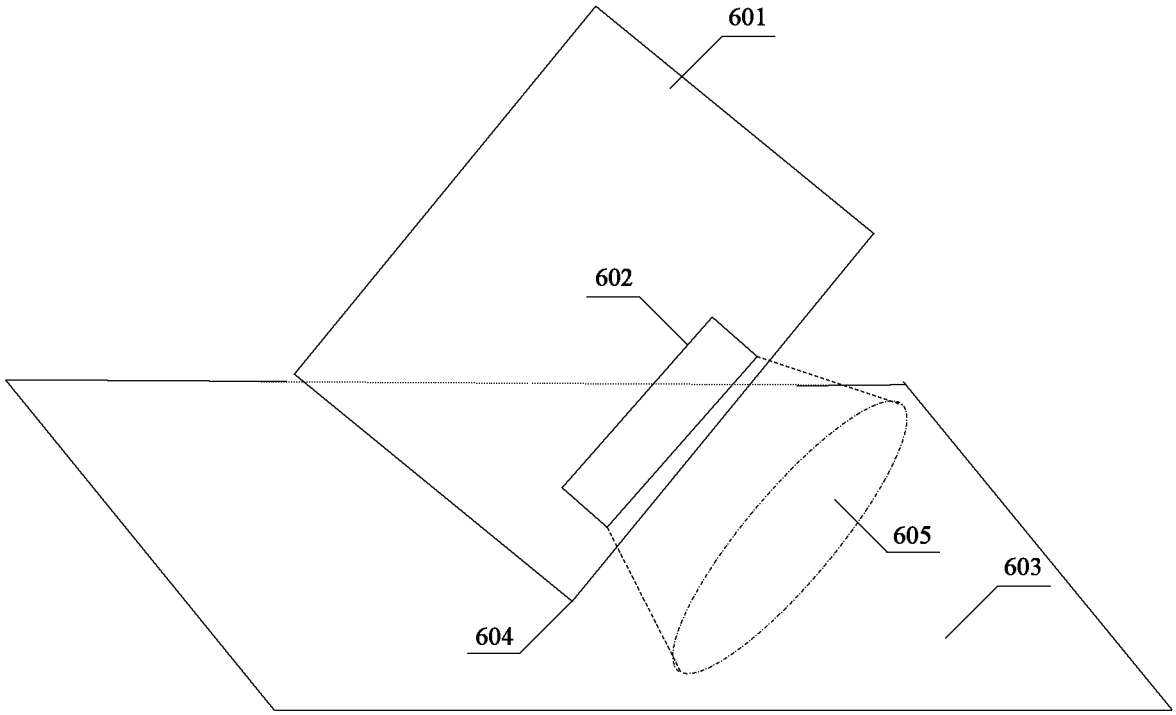
FIG. 6 is a diagram illustrating a targeted area according to certain embodiments of the present disclosure.

FIG. 6 illustrates a target region. As shown in FIG. 6, a first audio output element 602 may be configured in the electronic device 601. A sound emission range of the first audio output element 602 is indicated by the dashed lines. An interference surface 603 is in contact with an edge 604 of the electronic device. The interference surface includes a target region 605 (illustrated with a dotted-dash line) corresponding to the sound emission range of the first audio output element 602.

In FIG. 6, the bearing surface carrying the electronic device is regarded as the interference surface. Certain embodiments are not limited thereto, where the interference surface may be another surface in the proximity of the electronic device.

The electronic device may determine the target region corresponding to the sound emission range of the first audio output element in the electronic device according to the contact/proximity portion. The electronic device may determine an impact of the target region on the audio playback of the electronic device, for example, the impact on the audio playback of the first audio output element. According to certain embodiments, the electronic device may measure the material of the target region by measuring one a dielectric constant, a magnetic permeability, or a spectrum of the target region.

Step S503 is to acquire an adjustment parameter of the first audio output element according to the material of the target region. In certain embodiments, the interference surface may be close to or in contact with the electronic device, having a certain impact on the audio playback of the electronic device due to the its interaction with sound propagation. The interference surface made of different materials may have different impacts on the audio playback effects.

In certain embodiments, the electronic device may determine the impact of the target region on the audio playback of the audio output element according to the material of the target region. Thus, the electronic device may acquire the adjustment parameters for adjusting the audio output of the audio output element.

In certain embodiments, the material of the target region may affect the volume of a certain frequency in the audio. The electronic device may acquire a volume change value at the frequency. In order to reduce the target region's impact on the audio playback of the first audio output element, the electronic device may adjust the volume at the frequency in the audio output of the first audio output element accordingly.

In certain embodiments, the material of the target region may have a natural frequency causing an audio resonance at the corresponding frequency in the audio output of the first audio output element, resulting a volume at the resonance frequency. Accordingly, the electronic device may reduce the volume at the corresponding frequency in the audio output of the first audio output element. The natural frequency may be a vibration frequency determined by physical factors such as density and shape of the object.

Step S504 is to adjust audio playback of the electronic device according to the first audio parameter. Step S504 may be consistent with Step S103 in the forgoing embodiments referencing FIG. 1, and its detailed description is not repeated.

In summary, in the audio adjustment method according to certain embodiments of the present disclosure, acquiring the interference parameter and determining the first audio parameter that matches the interference parameter may include: determining a first audio output element facing the interference surface from a plurality of audio output elements of the electronic device; determining a material of a target region corresponding to a sound emission range of the first audio output element; and acquiring the adjustment parameter of the first audio output element according to the material of the target region. Using the method, the electronic device may identify a first audio output element from a plurality of audio output elements of the electronic device. The electronic device may determine the adjustment parameter corresponding to the first audio output element according to the material of the target region corresponding to the sound emission range of the first audio output element. The adjustment parameter, in turn, can be used to adjust the audio output of the first audio output element to reduce the impact of the target region on sound quality.

Figure 7:
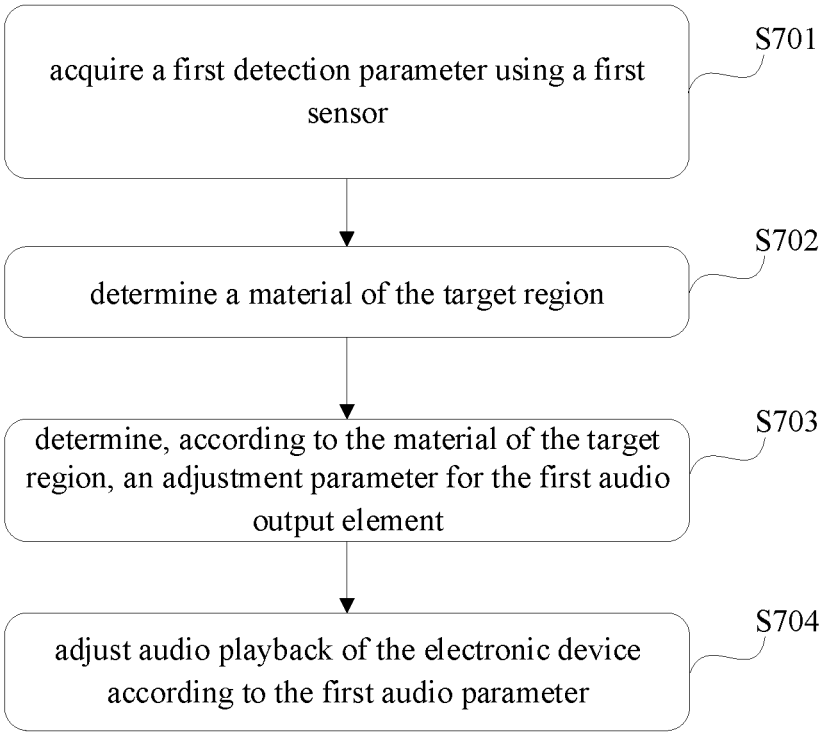
FIG. 7 is a flowchart illustrating an audio adjustment method according to certain embodiments of the present disclosure.

FIG. 7 illustrates an audio adjustment method according to certain embodiments of the present disclosure. As shown in FIG. 7, according to certain embodiments, an audio adjustment method may include the following the steps.

Step S701 is to acquire a first detection parameter using a first sensor, and to determine a first audio output element according to the first detection parameter. In certain embodiments, the sound emission directions of a plurality of audio output elements of the electronic device may be respectively matched with a plurality of detection directions of the first sensor. In certain embodiments, the first sensor may be a gravity sensor. The interference surface may be a bearing surface carrying the electronic device.

In certain embodiments, the plurality of audio output elements configured in the electronic device may be configured on multiple faces of the electronic device. When the electronic device is in different posture, the audio output elements configured on different faces thereof may have different relative positions with the bearing surface. The sound emission direction of one or more audio output elements may face the bearing surface. The sound emission directions of certain other audio output elements may not face the bearing surface.

In certain embodiments, the first sensor may detect the posture of the electronic device. Based on the posture of the electronic device, the electronic device may determine the relative positions between the electronic device and the bearing surface carrying the electronic device. Based on the relative positions, the electronic device may determine a first audio output element facing the bearing surface. The sound emission direction of the first audio output element may be directed toward the bearing surface.

Step S702 is to determine a material of the target region. Step S703 is to determine, according to the material of the target region, an adjustment parameter for the first audio output element. Step S704 is to adjust audio playback of the electronic device according to the first audio parameter. Steps S702-S704 may be consistent with Steps S502-S504 in the forgoing embodiments referencing FIG. 5, and their detailed descriptions are not repeated.

In summary, in an audio adjustment method according to certain embodiments of the present disclosure, determining the first audio output element from a plurality of audio output elements of the electronic device may include: acquiring the first detection parameter using a first sensor. The sound emission directions of a plurality of audio output elements of the electronic device may be respectively matched with a plurality of detection directions of the first sensor. With the method, the electronic device may determine the first audio output element from a plurality of audio output elements of the electronic device based on the first detection parameter acquired by the first sensor. Thus, the electronic device may subsequently make adjustment for audio playback of the first audio output element.

Figure 8:
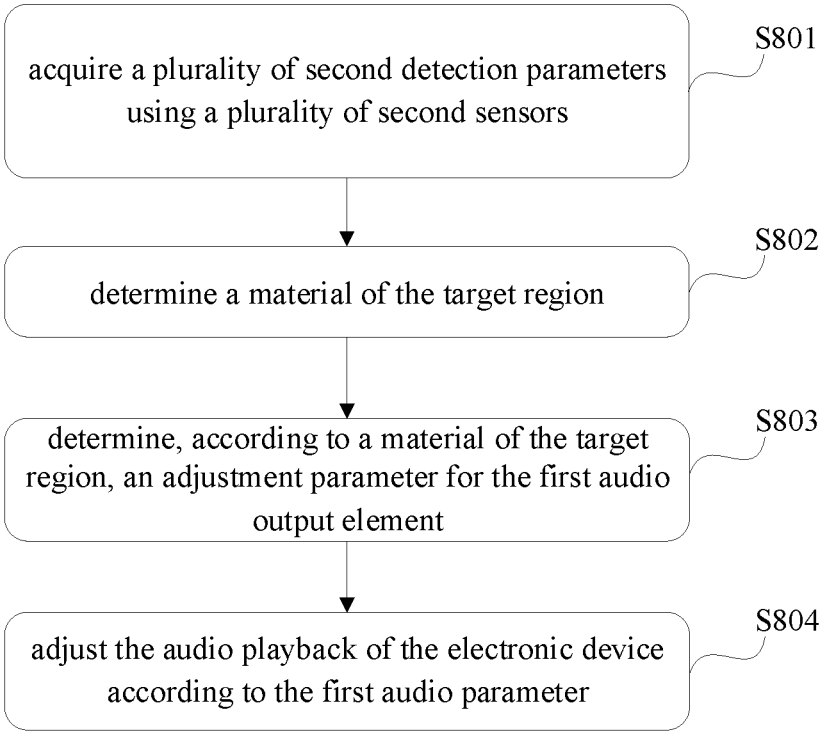
FIG. 8 is a flowchart illustrating an audio adjustment method according to certain other embodiments of the present disclosure.

FIG. 8 is a illustrates an audio adjustment method according to certain other embodiments of the present disclosure. As shown in FIG. 8, according to certain embodiments, the audio adjustment method may include the following the steps.

Step S801 is to acquire a plurality of second detection parameters using a plurality of second sensors, and determine a first audio output element according to the plurality of second detection parameters. The plurality of second sensors may be respectively configured on the sound emitting planes of a plurality of audio output elements of the electronic device.

The second sensors may be implemented as one of a capacitive proximity sensor, a magnetic permeability sensor, or a spectrum analyzer. The second sensors may include a plurality of sensor elements. Each sensor element may be respectively configured on a sound emitting plane of an audio output element of the electronic device. The electronic device may determine a sound emission range corresponding to the sound emitting plane according to the detection parameters. The electronic device may determine the interference surface corresponding to the sound emitting plane of the first audio output element.

In certain embodiments, the electronic device may determine the material of the interference surface by using the second sensors to measure one or more of a dielectric constant, a magnetic permeability, a spectrum, and the like of the interference surface. In certain embodiments, different types of detection methods, such as contact detection and non-contact detection, may be implemented according to the sensing mechanism of the second sensors.

In certain embodiments, a contact-type measurement may be more robust against interference. However, only the material of the area directly in contact with the sensor is measured. When there is an angle between the electronic device and the interference surface (the electronic device is inclined with respect to the interference surface), the measurement result may only correspond to the material of the region in contact, and may be different from the target region. Therefore, the measurement result may be inaccurate.

When the sound emission direction of the audio output element of the electronic device faces the interference surface, and the distance between the two is small (less than a certain threshold), the audio output element (such as a speaker) of the electronic device may be considered as abutting the interference surface. Correspondingly, the second sensor configured on the sound emitting plane of the audio output element may contact the target region, that is, the target region corresponds to the contact area, and the detection result may not be affected.

In certain embodiments, a non-contact measurement method may be adopted, such as a spectral measurement.

Step S802 is to determine a material of the target region. Step S803 is to determine, according to a material of the target region, an adjustment parameter for the first audio output element. Step S804 is to adjust the audio playback of the electronic device according to the first audio parameter. Steps S802-S804 may be consistent with Steps S502-S504 in the forgoing embodiments referencing FIG. 5, and their detailed descriptions are not repeated.

In summary, in an audio adjustment method according to certain embodiments of the present disclosure, determining the first audio output element from a plurality of audio output elements of the electronic device may include: acquiring a plurality of second detection parameters using a plurality of second sensors; and identifying a first audio output element according to the plurality of second detection parameters. The plurality of second sensors may be respectively configured on the sound emitting planes of a plurality of audio output elements of the electronic device. With the method, the electronic device may identify the first audio output element from a plurality of audio output elements of the electronic device according to the second detection parameters using the second sensors. Then the electronic device may make adjustment for audio playback of the first audio output element.

Figure 9:
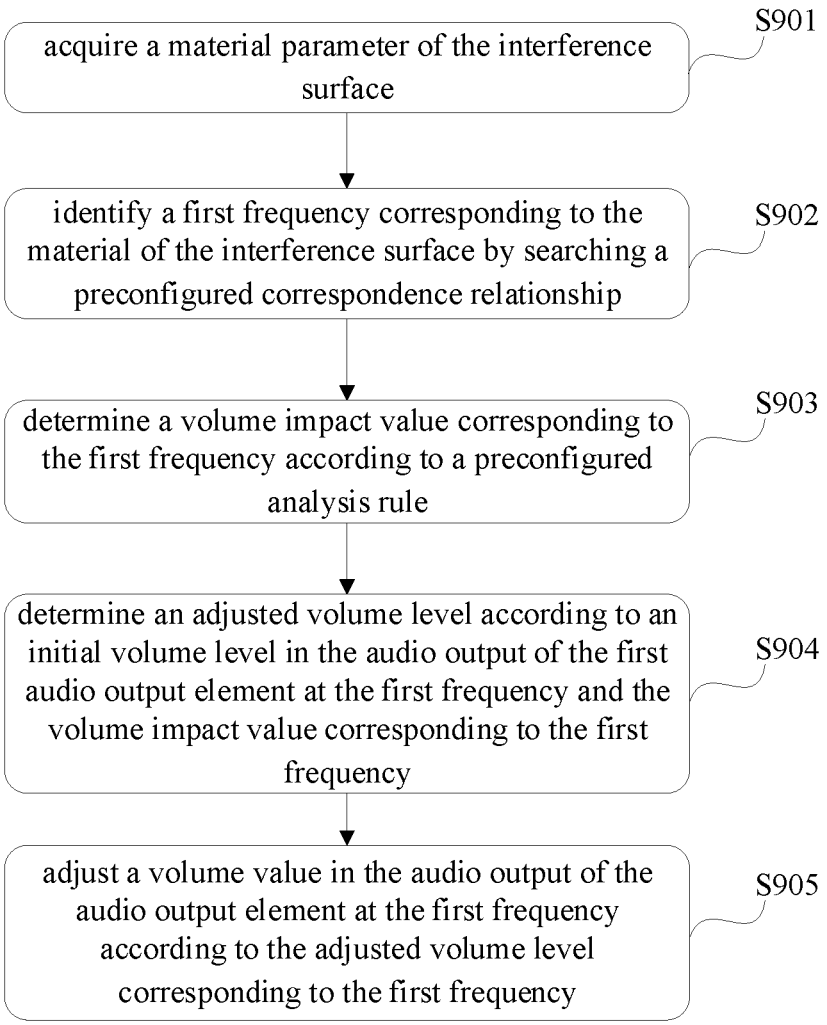
FIG. 9 is a flowchart illustrating an audio adjustment method according to certain other embodiments of the present disclosure.

FIG. 9 illustrates an audio adjustment method according to certain other embodiments of the present disclosure. As shown in FIG. 9, according to certain embodiments, an audio adjustment method may include the following the steps.

Step S901 is to acquire a material parameter of the interference surface. Step S901 may be consistent with Step S401 in the forgoing embodiments referencing FIG. 4, and its detailed description is not repeated.

Step S902 is to find a first frequency corresponding to the material of the interference surface by searching a preconfigured correspondence relationship. In certain embodiments, the first audio output element may be close to but not in contact with the interference surface. For example, when the first audio output element is a speaker, the audio output port of the speaker may be abutting the interference surface. The interference surface may have an impact on the audio playback of the first audio output element.

In certain embodiments, due to a natural frequency of its material, the target region may have an audio resonance at a corresponding frequency, so that the volume from the first audio output element at the corresponding frequency may be increased.

The corresponding relationship between the various materials and their natural frequencies may be preconfigured in the electronic device by importing measurement data. Thus, the electronic device may identify the corresponding first frequency according to the material of the interference surface.

Step S903 is to determine a volume impact value corresponding to the first frequency according to a preconfigured analysis rule. The interference surface may impact the sound quality of the audio output element due to sound resonance. The interference surface may have a resonance effect on the audio output of the audio output element at the first frequency by increasing the volume at the first frequency.

In certain embodiments, an analysis model may be preconfigured in the electronic device. The electronic device may identify the first frequency corresponding to the material and its impact on the output volume corresponding to the first frequency according to the analysis model. The volume impact value may be used to characterize the impact on the first audio output element at the first frequency.

Step S904 is to determine an adjusted volume level according to an initial volume level in the audio output of the first audio output element at the first frequency and the volume impact value corresponding to the first frequency.

Based on the initial volume level and the volume impact value, the electronic device may determine the adjusted volume level according to calculation. For example, if the initial volume level is 25 and the volume impact value is +10, the adjusted volume level may be calculated as 25−(+10)=15.

The "+" in the volume impact value indicates that the impact on the volume in the audio output of the first audio output element at the first frequency is a volume increase. In order to reduce the impact, the electronic device may reduce the volume at the corresponding frequency in the audio output of the audio output element.

Step S905 is to adjust a volume level in the audio output of the audio output element at the first frequency according to the adjusted volume level corresponding to the first frequency. The volume level at the first frequency in the audio output of the audio output element may be modified by using the adjusted volume level corresponding to the first audio to compensate for the impact of the interference surface on the audio output at the first frequency.

For example, the initial volume level at the first frequency in the audio output of the audio output element may be 25. The volume impact value may be +10. The volume level at the first frequency may be reset to 15.

In certain embodiments, the adjustment may be implemented by adjusting the amplitude of the corresponding waveform (such as a sinusoidal wave) at the first frequency.

In summary, in an audio adjustment method according to certain embodiments of the present disclosure, the electronic device may determine the first audio parameter that matches the interference parameter. Adjusting the audio playback of the electronic device according to the first audio parameter may include: finding a first frequency corresponding to the material of the interference surface by searching a preconfigured correspondence relationship; determining a volume impact value corresponding to the first frequency according to a preconfigured analysis rule; and adjusting a volume level in the audio output of the audio output element at the first frequency according to the adjusted volume level at to the first frequency. By adopting the method, the impact of the interference surface on the audio output may be reduced.

Figure 10:
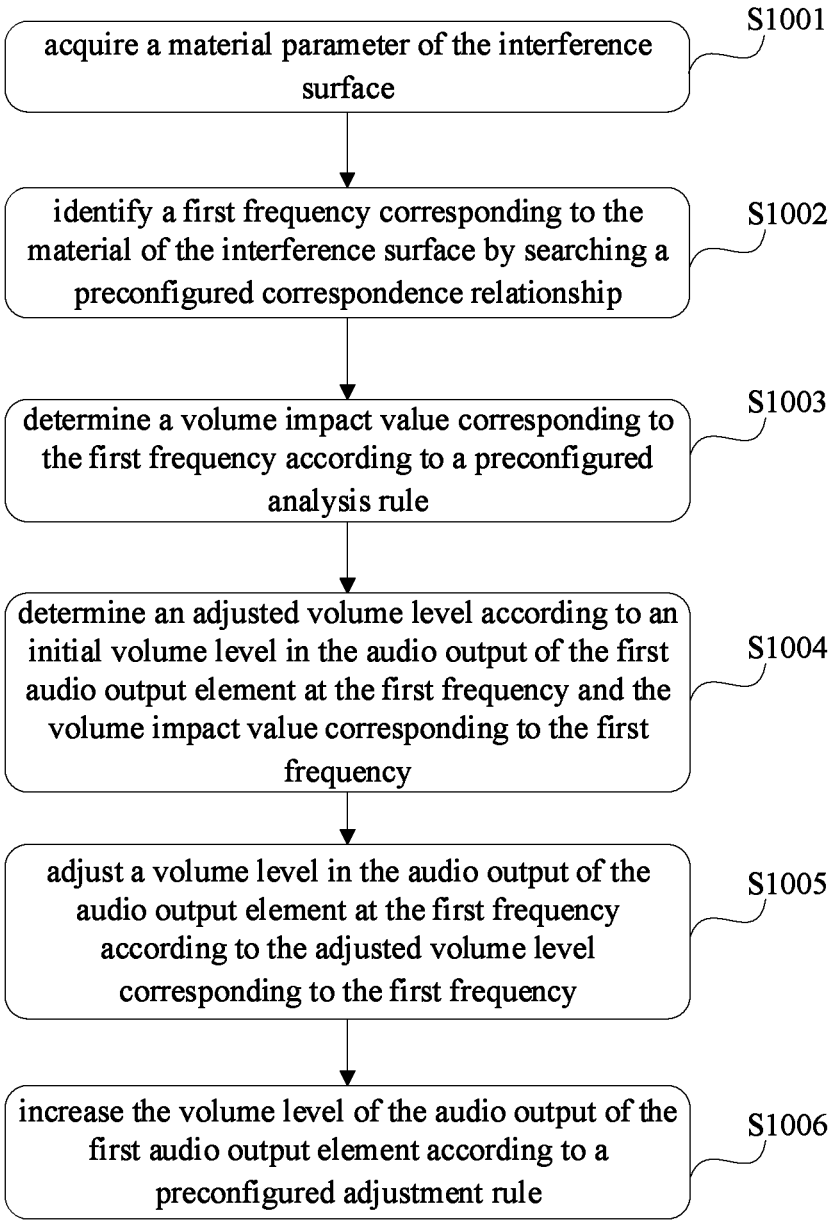
FIG. 10 is a flowchart illustrating an audio adjustment method according to certain other embodiments of the present disclosure.

FIG. 10 illustrates an audio adjustment method according to certain other embodiments of the present disclosure. As shown in FIG. 10, according to certain embodiments, an audio adjustment method may include the following the steps.

Step S1001 is to acquire a material parameter of the interference surface. Step S1002 is to find a first frequency corresponding to the material of the interference surface by searching a preconfigured correspondence relationship. Step S1003 is to determine a volume impact value corresponding to the first frequency according to a preconfigured analysis rule. Step S1004 is to determine an adjusted volume level according to an initial volume level in the audio output of the first audio output element at the first frequency and the volume impact value corresponding to the first frequency. Step S1005 is to adjust a volume level in the audio output of the audio output element at the first frequency according to the adjusted volume level corresponding to the first frequency. Steps S1001-S1005 may be consistent with Steps S901-S905 in the forgoing embodiments referencing FIG. 9, and their detailed descriptions are not repeated.

Step S1006 is to increase the volume level of the audio output of the first audio output element according to a preconfigured adjustment rule. In certain embodiments, the first audio output element may be close to the interference surface. When the first audio output element is close to the interference surface, the interference surface may affect the volume of the overall audio output of the first audio output element. Thus, the electronic device may also adjust the overall volume.

In certain embodiments, according to a preconfigured adjustment rule, the electronic device may determine the interference surface's impact on the overall output volume of the first audio output element through analysis. The impact may be a reduction of the output volume. Thus, the audio adjustment method may increase the volume level of the overall audio output of the first audio output element.

In summary, an audio adjustment method according to certain embodiments may further include: increasing a volume level in the audio output of the first audio output element according to a preconfigured adjustment rule. With this method, after adjusting the volume in the audio output of the first audio output element at the first frequency, the electronic device may adjust the overall volume of the audio output of the first audio output element to reduce the interference surface's impact affecting the overall output volume of the first audio output element.

In certain embodiments, one or more audio output elements in the electronic device may be in the proximity or in contact with the interference surface. Their audio qualities may be impacted by the interference surface. The impact on certain other audio output elements in the electronic device may be small. Further, the impact of a surrounding environment on the audio playback of the electronic device may be considered. The surrounding environment may include a placement space of the electronic device and a user location. The best sound quality at a specific user location may be consistent with the auditory experience in a studio that is free of sound reflections.

Figure 11:
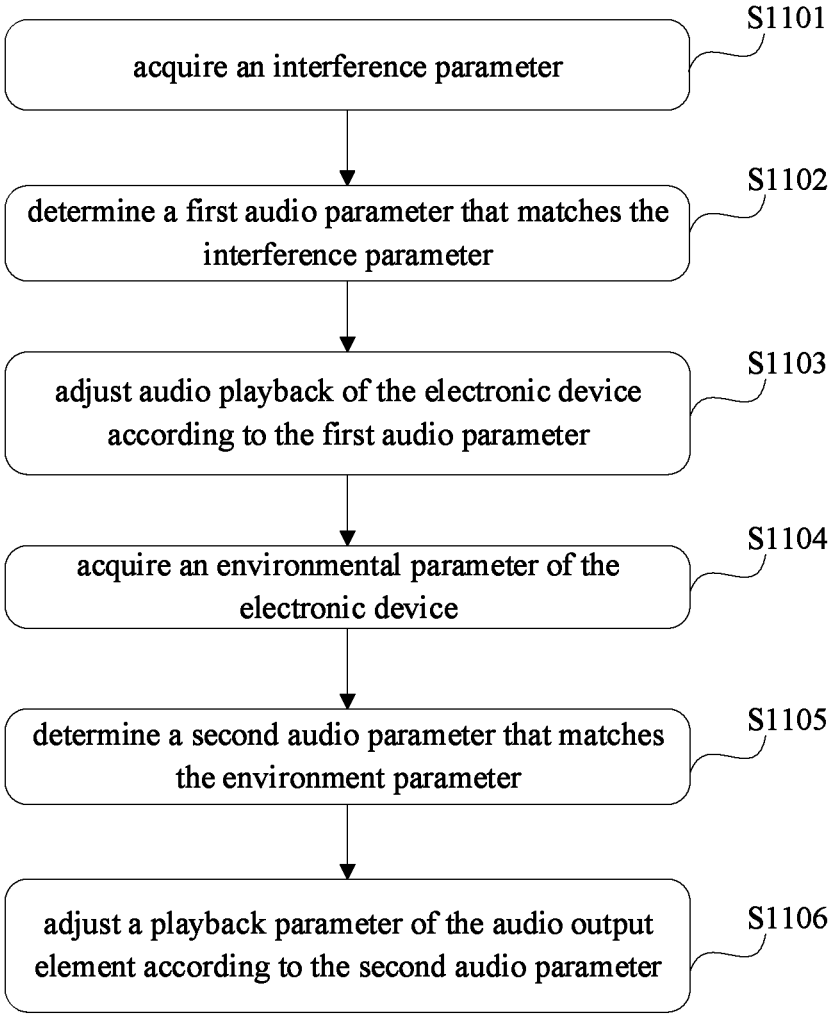
FIG. 11 is a flowchart illustrating an audio adjustment method according to certain other embodiments of the present disclosure.

FIG. 11 illustrates an audio adjustment method according to certain other embodiments of the present disclosure. As shown in FIG. 11, according to certain embodiments, an audio adjustment method may include the following the steps.

Step S1101 is to acquire an interference parameter. Step S1102 is to determine a first audio parameter that matches the interference parameter. Step S1103 is to adjust audio playback of the electronic device according to the first audio parameter. Steps S1101-S1103 may be consistent with Steps S101-S101 in the forgoing embodiments referencing FIG. 1, and their detailed descriptions are not repeated.

Step S1104 is to acquire an environmental parameter of the electronic device. The environmental parameter of the electronic device may be acquired according to analysis of an image including the electronic device. In certain embodiments, the image may include an environment in which the electronic device is located. The environment may include objects in the vicinity of the electronic device, a user (or a seat where the user is located). The objects in the vicinity of the electronic device may include other objects on the bearing surface of the electronic device, and other objects (such as a table, a sofa, etc.) in the same environment as the bearing surface. In certain embodiments, the image may be acquired by a camera provided in the electronic device, or may be inputted to the electronic device through other devices.

Step S1105 is to determine a second audio parameter that matches the environment parameter. By analyzing the image, the electronic device may acquire an environmental parameter of a space in which the electronic device is located. The environment parameter may characterize a first relative positional relationship between an audio output element of the electronic device and an obstacle in the environment where the electronic device is located. Further, the environment parameter may characterize a second relative positional relationship between the audio output element and a user.

The electronic device may determine that the user is located at a target location, and determine a second frequency corresponding to the target location as well as an adjusted volume level corresponding to the second frequency according to playback parameters of the audio output element in a preconfigured calculation model and analysis of the first relative position relationship and the second relative position relationship. The second frequency may be a frequency at which the sound quality is worse at the target location compared to sound quality at other locations.

The sound emitted by the audio output element may be mixed with the sound reflected by the obstacle, so that the sound quality at the target location may be worse than the sound quality at other positions. In certain embodiments, the target location may be a standing wave point, or a location where sound quality is affected. For different audio output elements, the corresponding target locations may be different, and the corresponding adjusted volume levels may also different.

Step S1106 is to adjust a playback parameter of the audio output element according to the second audio parameter. In certain embodiments, the electronic device may adjust the volume level corresponding to the second frequency in the audio output of the audio output element according to the adjusted volume level corresponding to the second frequency, so that the playback parameter of the electronic device is adjusted.

In certain embodiments, the playback parameters are adjusted individually for different audio output elements. In certain embodiments, each audio output element may output audio separately. When adjusting the playback parameter of an audio output element in the electronic device, the electronic device may further account for the interaction between the respective audio output elements in the calculation and analysis. When calculating the playback parameters of the respective audio output elements, the electronic device may account for the relative positional relationship between the user and the electronic devices and the relative positional relationship between the user and the respective audio output elements of the electronic device.

In summary, the audio adjustment method according to embodiments may further include: acquiring an environmental parameter of the electronic device; determining a second audio parameter that matches the environmental parameter; and adjusting a playback parameter of an audio output element according to the second audio parameter. By adopting this method, the environment of the electronic device may be taken into consideration. The electronic device may adjust its playback parameters to optimize the sound quality.

Figure 12:
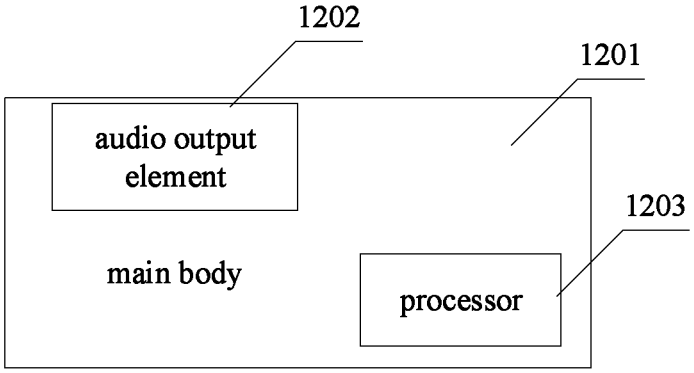
FIG. 12 is a diagram illustrating a structure of an electronic device according to certain embodiments of the present disclosure.

The present disclosure further provides an electronic device that applies the audio adjustment method according to the foregoing embodiments. FIG. 12 illustrates a structure of an electronic device that applies the audio adjustment method described in the embodiments referring FIG. 1. The electronic device has an audio playback function. As shown in FIG. 12, the electronic device may include: a main body 1201, an audio output element 1202, and a processor 1203. The audio output element 1202 may be configured in the main body 1201 for playing audio.

The electronic device may be configured with one or more audio output elements 1202. When there are a plurality of audio output elements, the audio output elements may be configured on different faces of the electronic device.

The processor 1203 may be configured in the main body 1201, and configured to acquire an interference parameter, determine a first audio parameter that matches the interference parameter, and adjust audio playback of the electronic device according to the first audio parameter. The interference parameter may characterize an impact of an interference surface on the audio output of the electronic device. The interference surface may be defined as a surface that is close to or in contact with the electronic device.

In FIG. 12, two audio output elements are visible on two adjacent faces of the electronic device. The placement configuration of the audio output elements is not limited thereto. In other embodiments, the number and placement positions of the audio output elements may be varied.

In summary, an electronic device according to certain embodiments may include: a main body; an audio output element configured to play audio and configured in the main body; and a processor configured in the main body and configured to acquire an interference parameter, determine a first audio parameter that matches the interference parameter, and adjust the audio playback of the electronic device according to the first audio parameter. The electronic device may adjust the playback parameters accounting for the impact of an interference surface close to or in contact with the electronic device, and optimize the sound quality of the electronic device.

Figure 13:
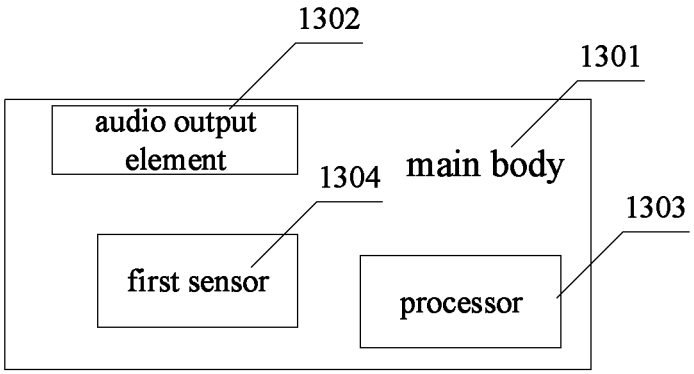
FIG. 13 is a diagram illustrating a structure of an electronic device according to certain other embodiments of the present disclosure.

FIG. 13 illustrates the structure of an electronic device that applies the audio adjustment method described in the embodiments referring FIG. 2. The electronic device has an audio playback function. As shown in FIG. 13, the electronic device may include: a main body 1301, an audio output element 1302, a processor 1303, and a first sensor 1304.

The main body 1301, the audio output element 1302, and the processor 1303 may be consistent with the main body 1201, the audio output element 1202, and the processor 1203 in the forgoing embodiments referring FIG. 12, and their descriptions are not repeated.

The first sensor 1304 may be configured in the main body 1301. The first sensor may be configured with its detection direction matching a sound emission direction of at least one audio output element of the electronic device. A plurality of detection directions of the first sensor may be respectively matched to the sound emission directions of a plurality of audio output elements of the electronic device. The first sensor may be configured to measure a first detection parameter.

The processor 1303 may be configured to determine whether the sound emission direction of an audio output element of the electronic device is directed toward the interference surface according to the first detection parameter. The interference surface may be a bearing surface carrying the electronic device.

In certain embodiments, the first sensor may be a gravity sensor. In certain embodiments, the gravity sensor may determine a posture of the electronic device, and acquire a first detection parameter that characterizes the posture of the electronic device. Based on the posture of the electronic device, the electronic device may determine a relative position between the electronic device and the bearing surface carrying the electronic device.

Figure 14:
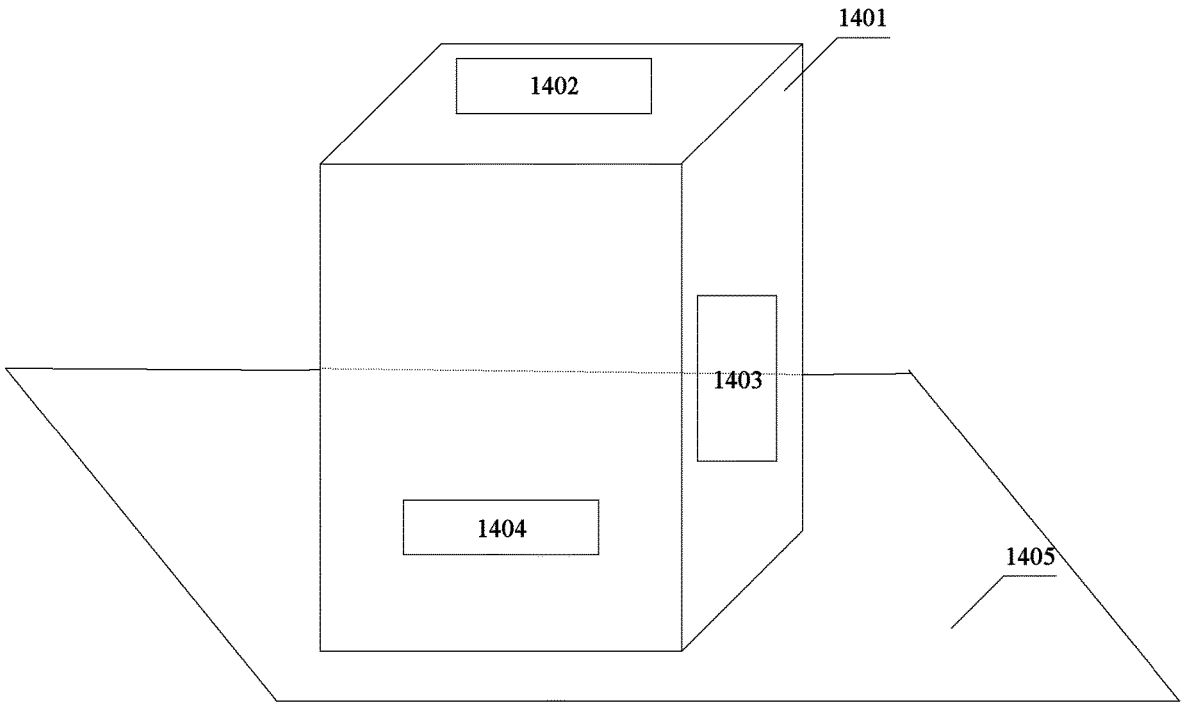
FIG. 14 is a diagram illustrating a placement configuration of an electronic device according to certain embodiments of the present disclosure.

FIG. 14 illustrates a placement configuration of an electronic device according to certain embodiments of the present disclosure. As shown in FIG. 14, the electronic device 1401 may be in an upright placement position on a bearing surface 1405. Three audio output elements 1402-1404 may be configured in the electronic device. The audio output element 1402 may be configured on a top surface of the electronic device. The audio output elements 1403 and 1404 may be respectively configured on two adjacent sides of the electronic device.

Figure 15:
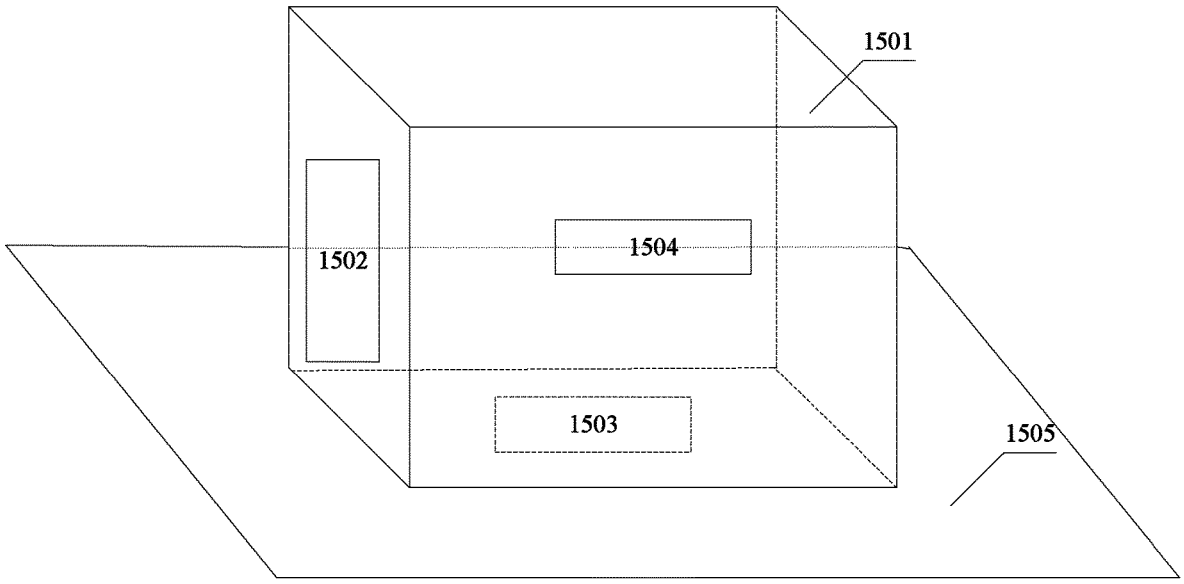
FIG. 15 is a diagram illustrating a placement configuration of an electronic device according to certain other embodiments of the present disclosure.

FIG. 15 illustrates another placement configuration of an electronic device according to certain embodiments of the present disclosure. The electronic device is in a second posture. As shown in FIG. 15, the electronic device 1501 may be positioned sideways on a bearing surface 1505. Three audio output elements 1502-1504 are configured in the electronic device. The audio output element 1502 may be configured on a top surface of the electronic device. The audio output elements 1503 and 1504 may be respectively configured on two adjacent sides of the electronic device. The audio output element 1503 may be adjacent to the bearing surface 1505.

In certain embodiments, the processor may acquire a posture of the electronic device according to a first detection parameter. Based on the posture of the electronic device, the processor may determine the relative position between the electronic device and the bearing surface carrying the electronic device. Based on the relative position, the processor may determine a first audio output element facing the bearing surface. The sound emission direction of the first audio output element is directed toward the bearing surface.

In summary, an electronic device according to certain embodiments may further include a first sensor configured in the main body. The first sensor may be configured with its detection direction matching a sound emission direction of at least one audio output element of the electronic device. A plurality of detection directions of the first sensor may be respectively matched to the sound emission directions of a plurality of audio output elements of the electronic device. The first sensor may be configured to measure a first detection parameter. The processor may be configured to determine whether the sound emission direction of an audio output element of the electronic device is directed toward the interference surface according to the first detection parameter. The interference surface may be a bearing surface carrying the electronic device. The electronic device may determine the first audio output element from a plurality of audio output elements of the electronic device for subsequent adjustment of audio playback of the first audio output element.

Figure 16:
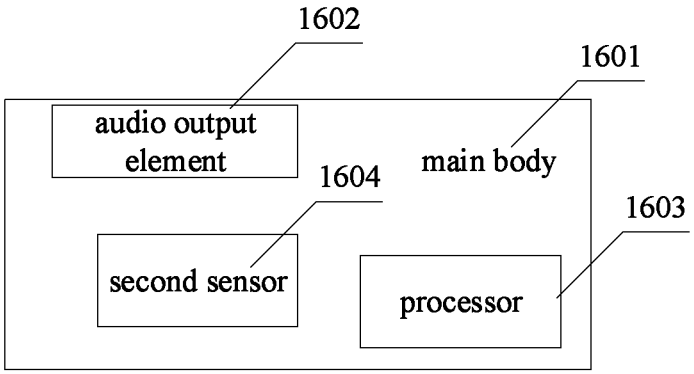
FIG. 16 is a diagram illustrating a structure of an electronic device according to certain embodiments of the present disclosure.

FIG. 16 illustrates a structure of an electronic device according to certain embodiments of the present disclosure. The electronic device may apply the audio adjustment method described in the embodiments referring FIG. 3. As shown in FIG. 16, the electronic device may include: a main body 1601, an audio output element 1602, a processor 1603, and a second sensor 1604.

The main body 1601, the audio output element 1602, and the processor 1603 may be consistent with the main body 1201, the audio output element 1202, and the processor 1203 in the forgoing embodiments referring FIG. 12, and their descriptions are not repeated.

The second sensor 1604 may be configured on a sound emitting plane of at least one audio output element of the electronic device. The second sensor 1604 may be configured to measure a material parameter of the interference surface that is close to or in contact with the sound emitting plane to acquire the second detection parameter. The processor 1603 may be configured to determine whether the sound emitting plane is close to or in contact with the interference surface according to the second detection parameter.

In certain embodiments, the second sensors may determine the material of the interference surface by measuring a dielectric constant, a magnetic permeability, a spectrum, or the like of the interference surface. In certain embodiments, the second sensors may be implemented as a capacitive proximity sensor, a magnetic permeability sensor, or a spectrum analyzer.

The second sensors may include a plurality of sensor elements. Each sensor element may be respectively configured on a sound emitting plane of an audio output element of the electronic device to make measurement corresponding to a sound emission range corresponding to the sound emitting plane. The electronic device may determine the interference surface corresponding to the sound emitting plane of the first audio output element.

Figure 17:
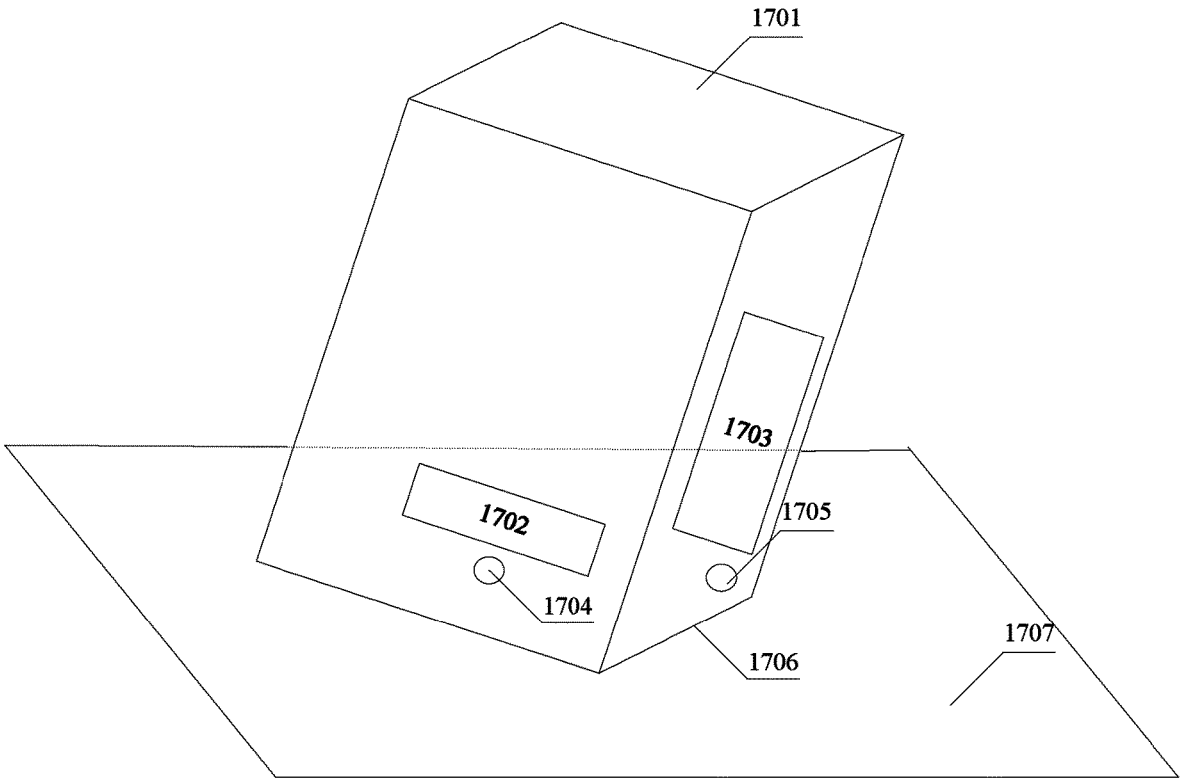
FIG. 17 is a diagram illustrating a structure of an electronic device according to certain other embodiments of the present disclosure.

FIG. 17 illustrates a placement configuration of an electronic device according to certain other embodiments of the present disclosure. As shown in FIG. 17, the electronic device 1701 may be configured with two audio output elements 1702 and 1703. The audio output element 1702 may be configured corresponding to a first surface of the electronic device, and the audio output device 1703 may be configured corresponding to a second surface of the electronic device. The second sensors 1704 and 1705 may be respectively configured on the sound emitting planes of the audio output elements. The electronic device may be in contact with the interference surface 1707 with an edge 1706. The first surface may be closer to the interference surface compared to the second surface.

Figure 18:
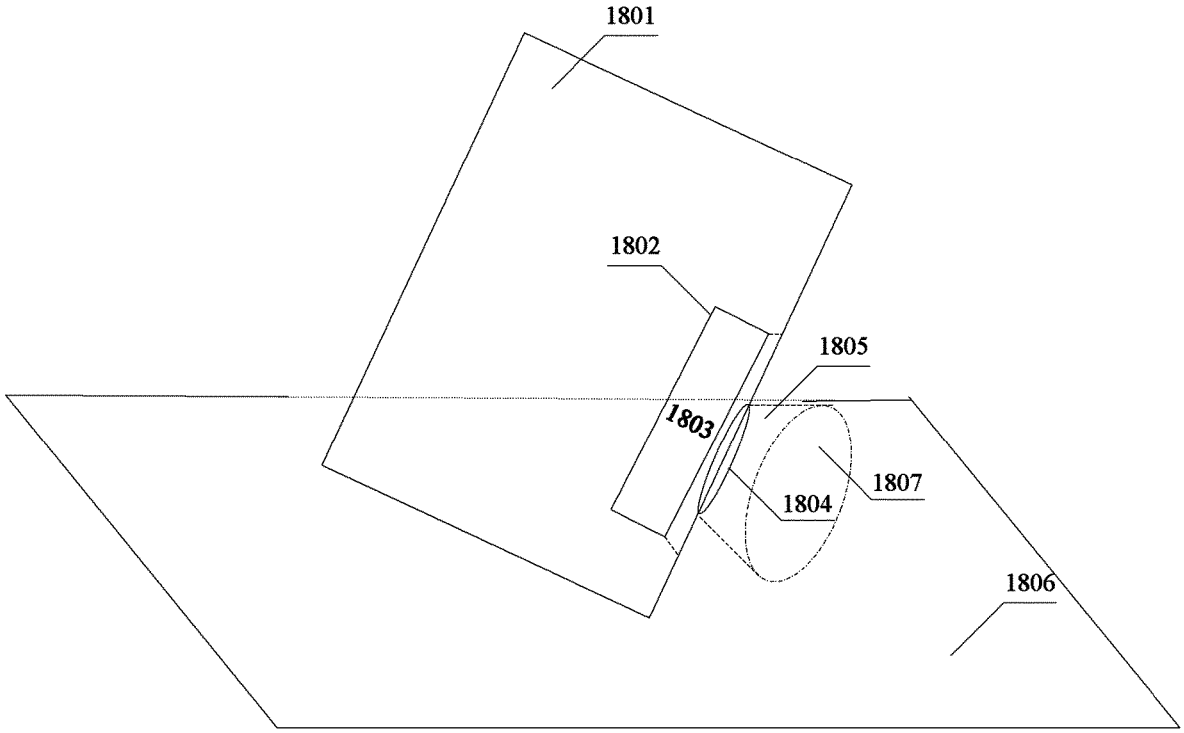
FIG. 18 is a diagram illustrating a placement configuration of an electronic device according to certain embodiments of the present disclosure.

FIG. 18 illustrates a placement configuration of an electronic device according to certain other embodiments of the present disclosure. FIG. 8 is a side-view diagram. As shown in FIG. 18, one side of the electronic device 1801 may be configured with an audio output element 1802. A sound emitting plane 1803 of the audio output element may be configured with a second sensor 1804. A sound emission range corresponding to the sound emitting plane 1803 may be slightly larger than the audio output port of the audio output element. The detection range of the second sensor 1804 may be a range defined by dashed lines 1805. The corresponding area 1807 on the interference surface 1806 is illustrated with the dotted-dash line.

In FIG. 17 and FIG. 18, the bearing surface that carries the electronic device is regarded as the interference surface. Certain embodiments are not limited thereto, where the interference surface may be a surface at another direction to the electronic device.

In FIG. 18, the audio output element is correspondingly provided with a single second sensor. Certain embodiments are not limited thereto, where a plurality of second sensors may be configured on the sound emitting plane of the audio output element, and respectively measure in a plurality of angular ranges of the sound emitting plane. The processor may determine whether the audio output element is close to or in contact with the interference surface by analyzing the multiple detection parameters.

In certain embodiments, the processor may determine whether the audio output element is close to or in contact with the interference surface by analyzing the second detection parameter acquired by the second sensor.

In certain embodiments, by analyzing the parameters collected by the plurality of second sensors, the processor may determine that the second detection parameter acquired by the second sensor on the sound emitting plane of one of the audio output elements is different from that of other audio output elements, and identify the audio output element as the one having its sound emitting plane close to or in contact with the interference surface.

In certain other embodiments, by analyzing the parameters collected by the plurality of second sensors, the processor may determine that the second detection parameter acquired by the second sensor on the sound emitting plane of one of the audio output elements that satisfies a preconfigured condition, and identify the audio output element as the one having its sound emitting plane close to or in contact with the interference surface.

In certain embodiments, the electronic device may also be connected to an input device, such as a keyboard, a touch screen, a mouse, etc., to implement manual input of material information by a user.

In summary, in certain embodiments, the electronic device may further include a second sensor. The second sensor may be configured on a sound emitting plane of at least one audio output element of the electronic device. The second sensor may be configured to measure a material parameter of the interference surface that is close to or in contact with the sound emitting plane to acquire a second detection parameter. With the method, the electronic device may determine the first audio output element from a plurality of audio output elements of the electronic device according to the second detection parameters of the second sensor for subsequent adjustment for audio playback of the first audio output element.

Certain embodiments in the present disclosure are described in a progressive manner. Among them, each embodiment may focus on a specific aspect, and the same or similar components or operations between the various embodiments may be referred to each other. The electronic device according to certain embodiments may correspond to the method according to certain embodiments. Detailed description of the functions of certain components of the electronic device may be referred to the corresponding method embodiments.

The present disclosure is provided according to certain embodiments. Various modifications to these embodiments may be obvious to those skilled in the art, and the general principles defined herein may be implemented in other embodiments without departing from the spirit or scope of the disclosure. Therefore, the present disclosure is not limited to the embodiments described herein, but is to be accorded the broadest scope of the principles and features provided herein.

What is claimed is:

1. An audio adjustment method for an electronic device having an audio playback function, the method comprising:

acquiring a plurality of detection parameters via a plurality of sensors, the plurality of sensors being placed on a sound emitting plane of an audio output element of the electronic device and respectively performing measurements in a plurality of angular ranges of the sound emitting plane, each of the plurality of sensors being configured to measure one or more of a dielectric constant or a magnetic permeability of a material;

acquiring an interference parameter according to the plurality of detection parameters measured in the plurality of angular ranges of the sound emitting plane, the interference parameter characterizing an impact of an interference surface on the audio playback function of the electronic device;

determining a first audio parameter that corresponds to the interference parameter, including identifying a first frequency corresponding to a natural frequency of the interference surface that causes an audio resonance at the first frequency; and adjusting audio playback of the electronic device according to the first audio parameter, including adjusting a volume level of the audio playback at the first frequency.

2. The audio adjustment method according to claim 1, wherein acquiring the interference parameter comprises:

acquiring an occlusion parameter, the occlusion parameter characterizing an occlusion effect of the interference surface on the audio playback function of the electronic device.

3. The audio adjustment method of claim 1, wherein acquiring the interference parameter comprises:

acquiring a material parameter characterizing a material of the interference surface.

4. The audio adjustment method of claim 3, wherein acquiring the material parameter comprises one of:

measuring a dielectric constant of the interference surface, and determining the material of the interference surface according to the dielectric constant; or measuring a magnetic permeability of the interference surface, and determining the material of the interference surface according to the magnetic permeability.

5. The audio adjustment method of claim 3, wherein determining the first audio parameter that corresponds to the interference parameter comprises:

identifying the first frequency corresponding to the material of the interference surface by searching a correspondence relationship between a plurality of materials and a plurality of natural frequencies; and determining a volume impact value corresponding to the first frequency according to an analysis rule.

6. The method of claim 5, further comprising:

adjusting the volume level of the audio playback at the first frequency according to an adjustment rule.

7. The method according to claim 1, wherein determining the first audio parameter that corresponds to the interference parameter comprises:

identifying a first audio output element from a plurality of audio output elements, the first audio output element being an audio output element facing the interference surface;

determining a material of a target region of the interference surface, the target region corresponding to a sound emission range of the first audio output element; and acquiring an adjustment parameter of the first audio output element according to the material of the target region.

8. The method according to claim 7, wherein identifying the first audio output element from the plurality of audio output elements of the electronic device comprises:

acquiring a second plurality of detection parameters via a second plurality of sensor elements, each of the second plurality of sensor elements respectively placed on a sound emitting plane of one of the plurality of audio output elements of the electronic device; and identifying the first audio output element from the plurality of audio output elements according to the second plurality of detection parameters.

9. An electronic device having an audio playback function, comprising:

a main body;

an audio output element configured on the main body;

a plurality of sensors, the plurality of sensors being placed on a sound emitting plane of the audio output element of the electronic device and configured to measure a plurality of detection parameters in a plurality of angular ranges of the sound emitting plane, each of the plurality of sensors being configured to measure one or more of a dielectric constant or a magnetic permeability of a material; and a processor configured to:

acquire the plurality of detection parameters in a plurality of angular ranges via the plurality of sensors;

acquire an interference parameter according to the plurality of detection parameters in a plurality of angular ranges of the sound emitting plane, the interference parameter characterizing an impact of an interference surface on the audio playback function of the electronic device;

determine an audio parameter that corresponds to the interference parameter, including identifying a first frequency corresponding to a natural frequency of the interference surface that causes an audio resonance at the first frequency; and adjust audio playback of the electronic device according to the audio parameter, including adjusting a volume level of the audio playback at the first frequency.

10. The electronic device according to claim 9, wherein the processor is further configured to:

determine a material of the interference surface;

identify the first frequency corresponding to the material of the interference surface by searching a correspondence relationship between a plurality of materials and a plurality of natural frequencies;

determine a volume impact value corresponding to the first frequency according to an analysis rule;

determine an adjusted volume level according to an initial volume level in an audio output of the audio output element at the first frequency and the volume impact value corresponding to the first frequency; and adjust a volume level of the audio output of the audio output element at the first frequency.

11. The electronic device according to claim 10, wherein the processor is further configured to:

increase the volume level of the audio output of the audio output element according to an adjustment rule.

12. The electronic device according to claim 9, wherein the plurality of sensors include a plurality of capacitive proximity sensors.

* * * * *